US008253658B2

(12) United States Patent
Soh et al.

(10) Patent No.: US 8,253,658 B2
(45) Date of Patent: Aug. 28, 2012

(54) PLASMA DISPLAY APPARATUS INCLUDING AN ADDRESS ELECTRODE BEING ELECTRICALLY FLOATED IN A SUSTAIN PERIOD

(75) Inventors: Sangyoon Soh, Gumi (KR); Mukhee Kim, Gumi (KR); Yunkwon Jung, Gumi (KR)

(73) Assignee: LG Electronics Inc., Seoul (KR)

( * ) Notice: Subject to any disclaimer, the term of this patent is extended or adjusted under 35 U.S.C. 154(b) by 395 days.

(21) Appl. No.: 12/581,363

(22) Filed: Oct. 19, 2009

(65) Prior Publication Data

US 2010/0302225 A1 Dec. 2, 2010

(30) Foreign Application Priority Data

May 26, 2009 (KR) ..... 10-2009-0046112

(51) Int. Cl.
*G09G 3/28* (2006.01)

(52) U.S. Cl. ..... 345/66; 345/68

(58) Field of Classification Search ..... 345/60–72; 315/169.4

See application file for complete search history.

(56) References Cited

U.S. PATENT DOCUMENTS

| | | | | |
|---|---|---|---|---|
| 2006/0262041 | A1* | 11/2006 | An | 345/67 |
| 2007/0046582 | A1* | 3/2007 | Paik et al. | 345/68 |
| 2007/0091022 | A1* | 4/2007 | Moon | 345/67 |
| 2007/0097034 | A1* | 5/2007 | Kwak | 345/68 |
| 2008/0048572 | A1* | 2/2008 | Cho et al. | 315/169.4 |
| 2008/0088537 | A1* | 4/2008 | Moon | 345/60 |
| 2008/0252560 | A1* | 10/2008 | Lee et al. | 345/60 |

* cited by examiner

*Primary Examiner* — Chanh Nguyen
*Assistant Examiner* — Navin Lingaraju
(74) *Attorney, Agent, or Firm* — Ked & Associates, LLP

(57) ABSTRACT

A plasma display apparatus is disclosed. The plasma display apparatus a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell and a driver supplying a sustain signal to the scan electrode and the sustain electrode in a sustain period of at least one of a plurality of subfields of a frame. A sustain signal supplied to the scan electrode overlaps a sustain signal supplied to the sustain electrode in the sustain period. The address electrode is electrically floated in the sustain period.

9 Claims, 18 Drawing Sheets

(a)

(b)

PLASMA DISPLAY APPARATUS INCLUDING AN ADDRESS ELECTRODE BEING ELECTRICALLY FLOATED IN A SUSTAIN PERIOD

This application claims the benefit of Korea Patent Application No. 10-2009-0046112 filed on May 26, 2009, the entire contents of which is incorporated herein by reference for all purposes as if fully set forth herein.

BACKGROUND OF THE INVENTION

1. Field of the Invention

Embodiments of the invention relate to a plasma display apparatus.

2. Discussion of the Related Art

A plasma display apparatus includes a plasma display panel. The plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display apparatus comprising a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell and a driver that supplies a sustain signal to the scan electrode and the sustain electrode in a sustain period of at least one of a plurality of subfields of a frame, wherein a sustain signal supplied to the scan electrode and a sustain signal supplied to the sustain electrode overlap each other in the sustain period, and the address electrode is electrically floated in the sustain period.

In another aspect, there is a plasma display apparatus comprising a plasma display apparatus comprising a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell and a driver that supplies a sustain signal to the scan electrode and the sustain electrode in a sustain period of at least one of a plurality of subfields of a frame, wherein the sustain signal includes a rising period during which a voltage of the sustain signal rises, a hold period during which the voltage is held at a maximum voltage, and a falling period during which the voltage falls, wherein a rising period of a sustain signal supplied to the scan electrode overlaps a falling period of a sustain signal supplied to the sustain electrode in the sustain period, and a falling period of the sustain signal supplied to the scan electrode overlaps a rising period of the sustain signal supplied to the sustain electrode in the sustain period, wherein the address electrode is electrically floated in the sustain period.

In another aspect, there is a plasma display apparatus comprising a plasma display apparatus comprising a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell and a driver that supplies a sustain signal to the scan electrode and the sustain electrode in a sustain period of at least one of a plurality of subfields of a frame, wherein the sustain signal includes a rising period during which a voltage of the sustain signal rises, a hold period during which the voltage is held at a maximum voltage, and a falling period during which the voltage falls, wherein a rising period of a sustain signal supplied to the scan electrode overlaps a falling period of a sustain signal supplied to the sustain electrode in the sustain period, and a falling period of the sustain signal supplied to the scan electrode overlaps a rising period of the sustain signal supplied to the sustain electrode in the sustain period, wherein the address electrode is electrically floated in a period during which a voltage of the scan electrode and a voltage of the sustain electrode are held substantially constant in the sustain period.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
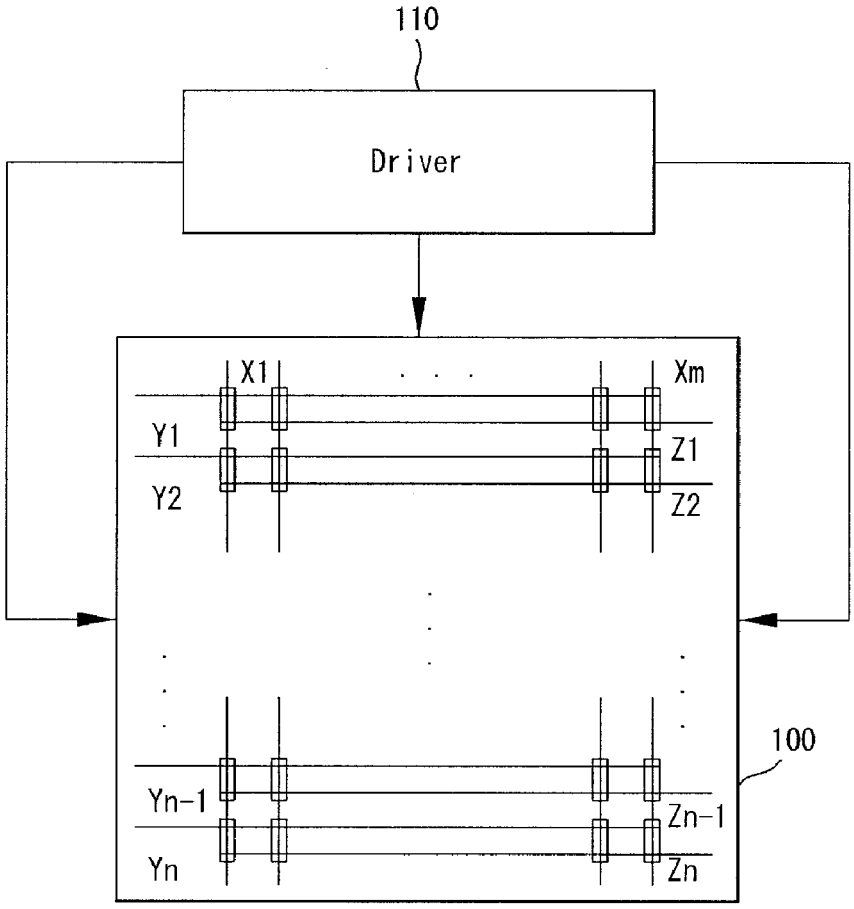
FIG. 1 illustrates an exemplary configuration of a plasma display apparatus according to an embodiment.

FIG. 1 illustrates an exemplary configuration of a plasma display apparatus according to an embodiment.

As shown in FIG. 1, the plasma display apparatus according to the exemplary embodiment may include a plasma display panel 100 and a driver 110.

The plasma display panel 100 may include scan electrodes Y1 to Yn and sustain electrodes Z1 to Zn positioned parallel to each other, and address electrodes X1 to Xm positioned to cross the scan electrodes Y1 to Yn and the sustain electrodes Z1 to Zn. The plasma display panel 100 may display an image in a frame including a plurality of subfields.

The driver 110 may supply driving signals to at least one of the scan electrodes Y1 to Yn, the sustain electrodes Z1 to Zn, or the address electrodes X1 to Xm and allow the image to be displayed on the screen of the plasma display panel 100. Preferably, the driver 110 may allow a sustain signal supplied to the scan electrode Y and a sustain signal supplied to the sustain electrode Z to overlap each other in a sustain period of at least one of a plurality of subfields of a frame and may allow the address electrode X to be floated in the sustain period.

Although FIG. 1 shows the driver 110 formed in the form of a signal board, the driver 110 may be formed in the form of a plurality of boards depending on the electrodes of the plasma display panel 100. For example, the driver 110 may include a first driver (not shown) for driving the scan electrodes Y1 to Yn, a second driver for driving the sustain electrodes Z1 to Zn, and a third driver (not shown) for driving the address electrodes X1 to Xm.

Figure 2:
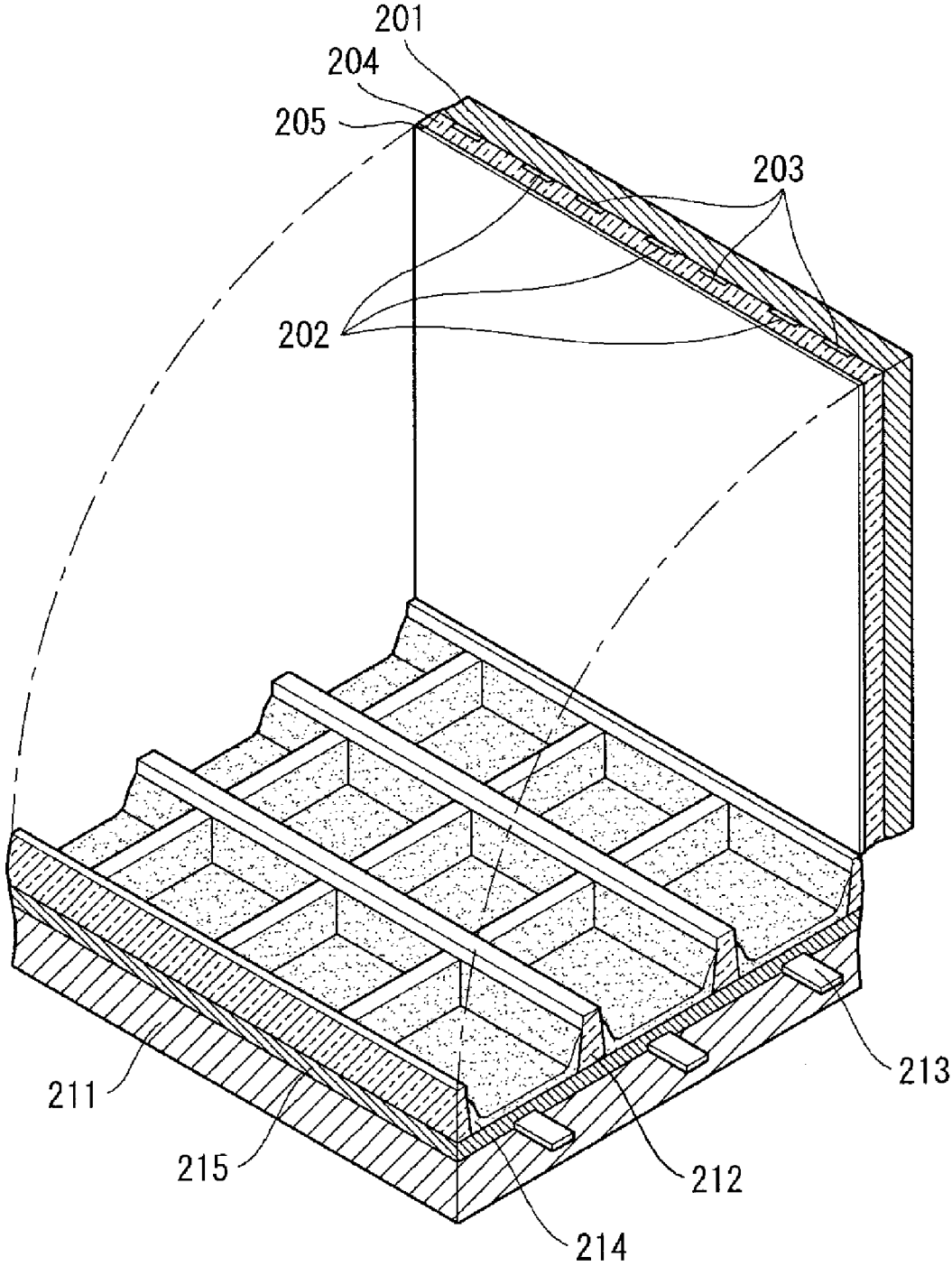
FIG. 2 illustrates an exemplary structure of a plasma display panel.

FIG. 2 illustrates an exemplary structure of the plasma display panel.

As shown in FIG. 2, the plasma display panel may include a front substrate 201, on which a scan electrode 202 and a sustain electrode 203 are formed substantially parallel to each other, and a rear substrate 211 on which an address electrode 213 is formed to cross the scan electrode 202 and the sustain electrode 203.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203. A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to partition discharge spaces (i.e., discharge cells). Hence, a first discharge cell emitting red light, a second discharge cell emitting blue light, and a third discharge cell emitting green light, etc. may be formed between the front substrate 201 and the rear substrate 211.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells partitioned by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

Figure 3:
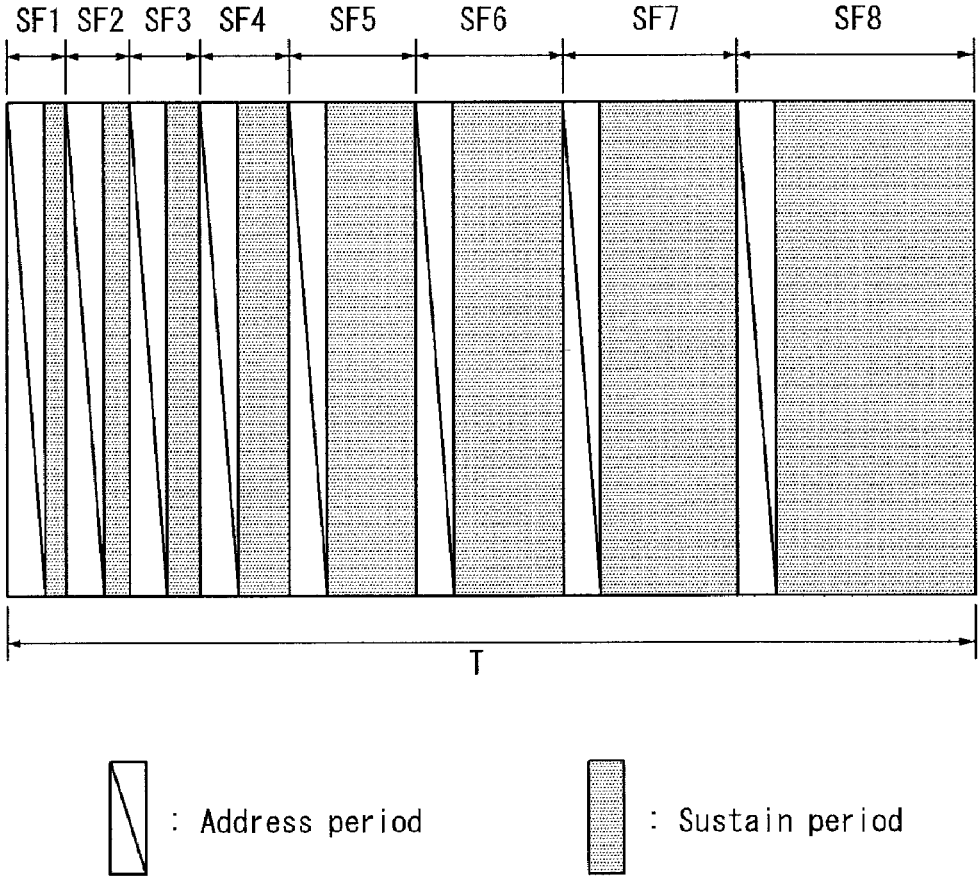
FIG. 3 illustrates a frame for achieving a gray scale of an image.

FIG. 3 illustrates a frame for achieving a gray scale of an image.

As shown in FIG. 3, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 3, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at 20 and a gray level of a second subfield at 21, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 3 shows that one frame includes 8 subfields, the number of subfields constituting a frame may vary. For example, a frame may include 10 or 12 subfields. Further, although FIG. 3 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

Figure 4:
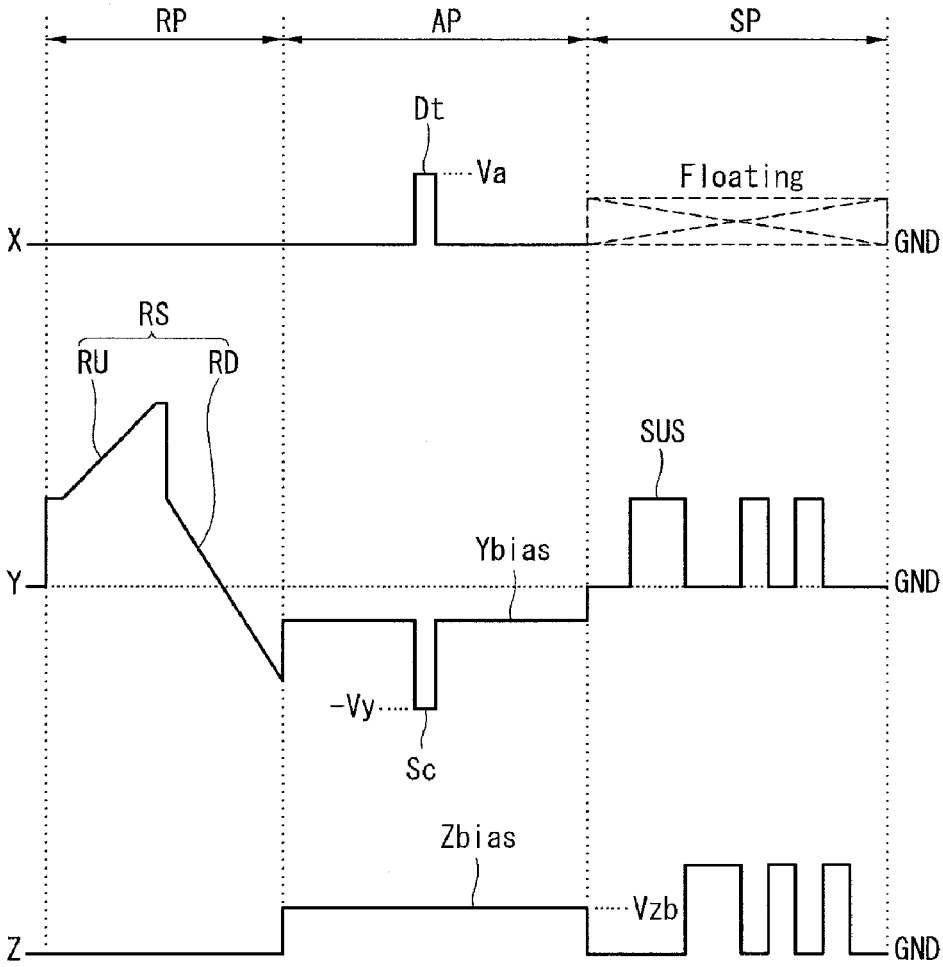
FIG. 4 illustrates an exemplary driving waveform of a plasma display apparatus.

FIG. 4 illustrates an exemplary driving waveform of the plasma display apparatus. A driving waveform to be described later is supplied by the driver 110 of FIG. 1.

As shown in FIG. 4, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, . . . , 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS is alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

An image may be displayed on the plasma display panel through the above-described driving method.

FIGS. 5 to 12 illustrate a method of driving the plasma display apparatus in a sustain period.

A sustain signal Y-SUS may include a rising period d1$y$ during which a voltage of the sustain signal Y-SUS gradually rises, a hold period d2$y$ during which the voltage is held at a maximum voltage (i.e., the sustain voltage Vs), and a falling period d3$y$ during which the voltage gradually falls. A sustain signal Z-SUS may include a rising period d1$z$ during which a voltage of the sustain signal Z-SUS gradually rises, a hold period d2$z$ during which the voltage is held at a maximum voltage (i.e., the sustain voltage Vs), and a falling period d3$z$ during which the voltage gradually falls.

More specifically, during the rising periods d1$y$ and d1$z$, the voltage of each of the sustain signals Y-SUS and Z-SUS may gradually rise from a ground level voltage GND. Although it is not shown, the rising periods d1$y$ and d1$z$ may be an ER-Up period during which an energy recovery circuit supplies a stored voltage to the scan electrode Y or the sustain electrode Z through LC resonance resulting from an inductor.

During the hold periods d2$y$ and d2$z$, the voltage of each of the sustain signals Y-SUS and Z-SUS may be clamped to the sustain voltage Vs.

During the falling periods d3$y$ and d3$z$, the voltage of each of the sustain signals Y-SUS and Z-SUS may gradually fall from the sustain voltage Vs. Although it is not shown, the falling periods d3$y$ and d3$z$ may be an ER-Down period during which the energy recovery circuit recovers a voltage from the scan electrode Y or the sustain electrode Z through LC resonance resulting from an inductor.

Figure 5:
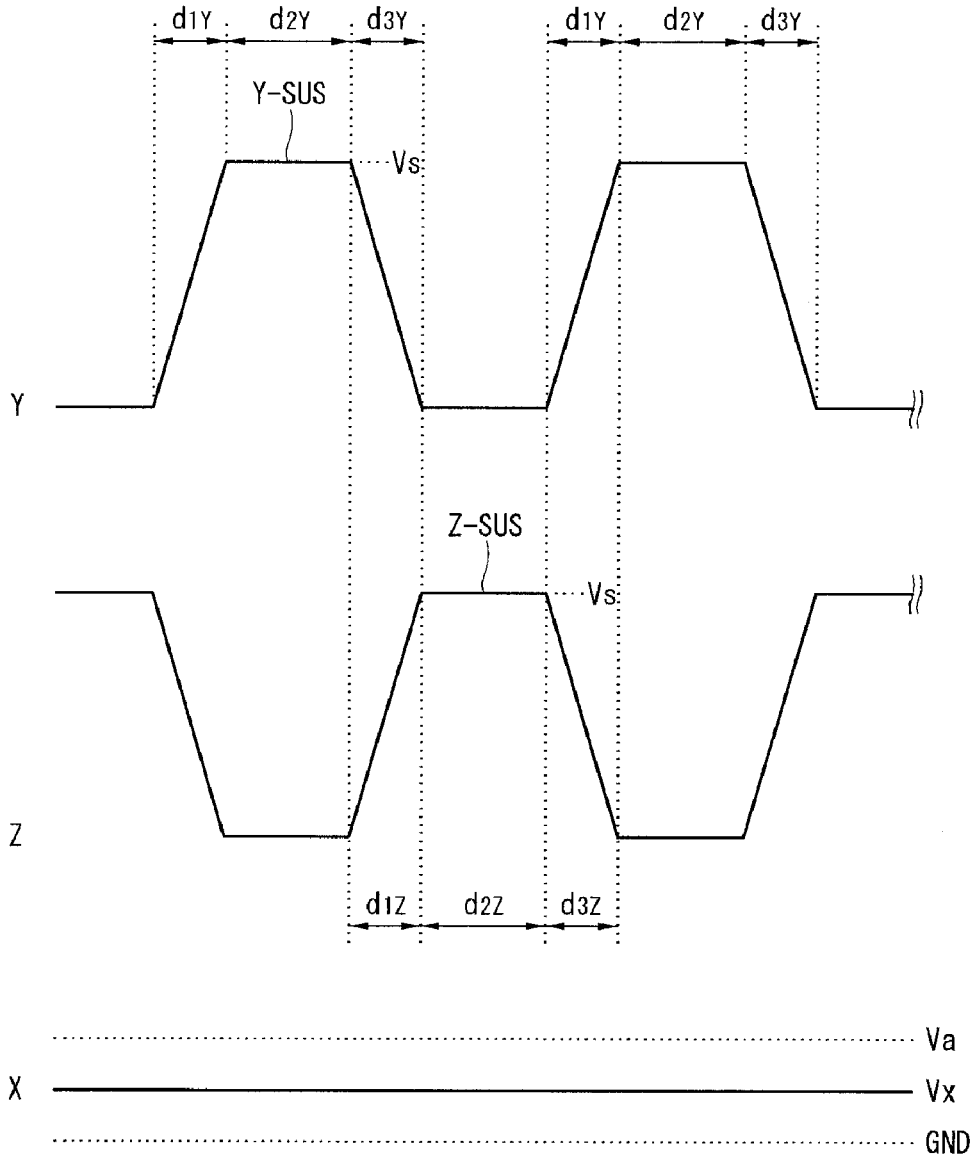
FIGS. 5 to 12 illustrate an exemplary driving method in a sustain period.

In the embodiment of the invention, as shown in FIG. 5, in the sustain period, the sustain signal Y-SUS supplied to the scan electrode Y and the sustain signal Z-SUS supplied to the sustain electrode Z may overlap each other, and the address electrode X may be electrically floated. The electrical floating of the address electrode X may mean that an electrical connection between the address electrode X and the driver is broken. In other words, the electrical floating of the address electrode X may mean that the address electrode X is electrically isolated without supplying a predetermined driving voltage to the address electrode X or grounding the address electrode X.

Preferably, in the sustain period, the rising period d1$y$ of the sustain signal Y-SUS supplied to the scan electrode Y and the falling period d3$z$ of the sustain signal Z-SUS supplied to the sustain electrode Z may overlap each other, and the falling period d3$y$ of the sustain signal Y-SUS supplied to the scan electrode Y and the rising period d1$z$ of the sustain signal Z-SUS supplied to the sustain electrode Z may overlap each other.

Further, the rising period d1$y$ of the sustain signal Y-SUS may fully overlap the falling period d3$z$ of the sustain signal Z-SUS. In this case, a length of the rising period d1$y$ of the sustain signal Y-SUS may be substantially equal to a length of the falling period d3$z$ of the sustain signal Z-SUS. The falling period d3$y$ of the sustain signal Y-SUS may fully overlap the rising period d1$z$ of the sustain signal Z-SUS. In this case, a length of the falling period d3$y$ of the sustain signal Y-SUS may be substantially equal to a length of the rising period d1$z$ of the sustain signal Z-SUS.

If the address electrode X is electrically floated under condition that the sustain signal Y-SUS supplied to the scan electrode Y fully overlaps the sustain signal Z-SUS supplied to the sustain electrode Z, a voltage of the address electrode X may be held constant during the sustain period as shown in FIG. 5. More specifically, the voltage of the address electrode X in the sustain period may be held at a voltage Vx greater than the ground level voltage GND and less than a maximum voltage Va of the data signal Dt supplied during the address period.

A reason to float the address electrode in the sustain period is described below.

Figure 6:
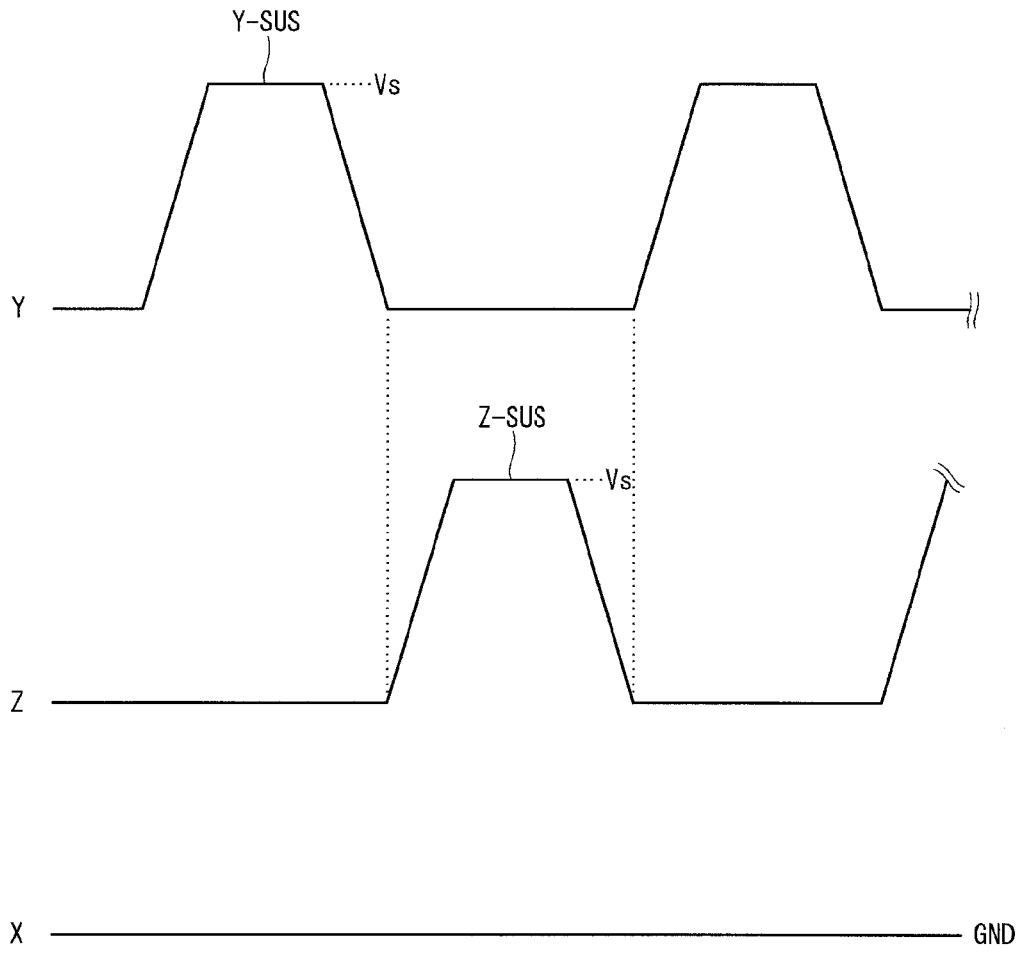

FIG. 6 illustrates that the ground level voltage GND is supplied to the address electrode X without floating the address electrode X in the sustain period. In this case, an opposite discharge may occur between the address electrode X and the scan electrode Y or the sustain electrode Z in the sustain period.

Figure 7:
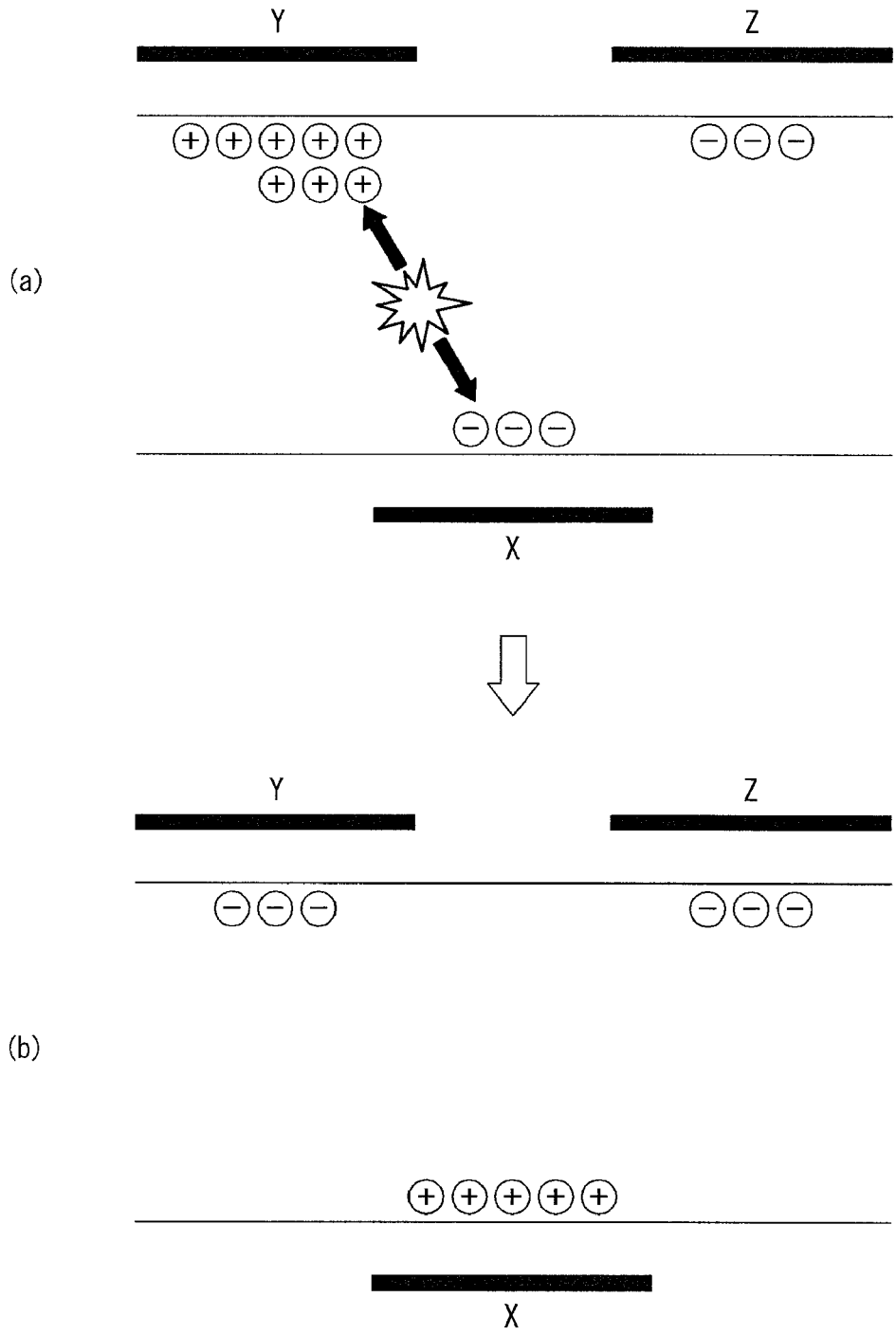

For example, as shown in (a) of FIG. 7, if the sustain voltage Vs is supplied to the scan electrode Y and the ground level voltage GND is supplied to the sustain electrode Z, positive charges may be accumulated on the scan electrode Y, negative charges may be accumulated on the sustain electrode Z, and negative charges may be accumulated on the address electrode X. In addition, if the ground level voltage GND is supplied to the address electrode X, a sustain discharge generated between the scan electrode Y and the sustain electrode Z may be drawn toward the address electrode X or an opposite discharge may occur between the scan electrode Y and the address electrode X. As a result, as shown in (b) of FIG. 7, after the generation of the opposite discharge, negative charges may be accumulated on the scan electrode Y, negative charges may be accumulated on the sustain electrode Z, and positive charges may be accumulated on the address electrode X.

Even if the sustain voltage Vs is supplied to the sustain electrode Z and the ground level voltage GND is supplied to the scan electrode Y in such a charge distribution state, the sustain discharge may not occur. A magnitude of the sustain voltage Vs has to further increase so as to generate the sustain discharge. However, the increase in the magnitude of the sustain voltage Vs may reduce the driving efficiency. Furthermore, if a distance between the scan electrode and the sustain electrode increases, the generation of the opposite discharge may further increase.

Figure 8:
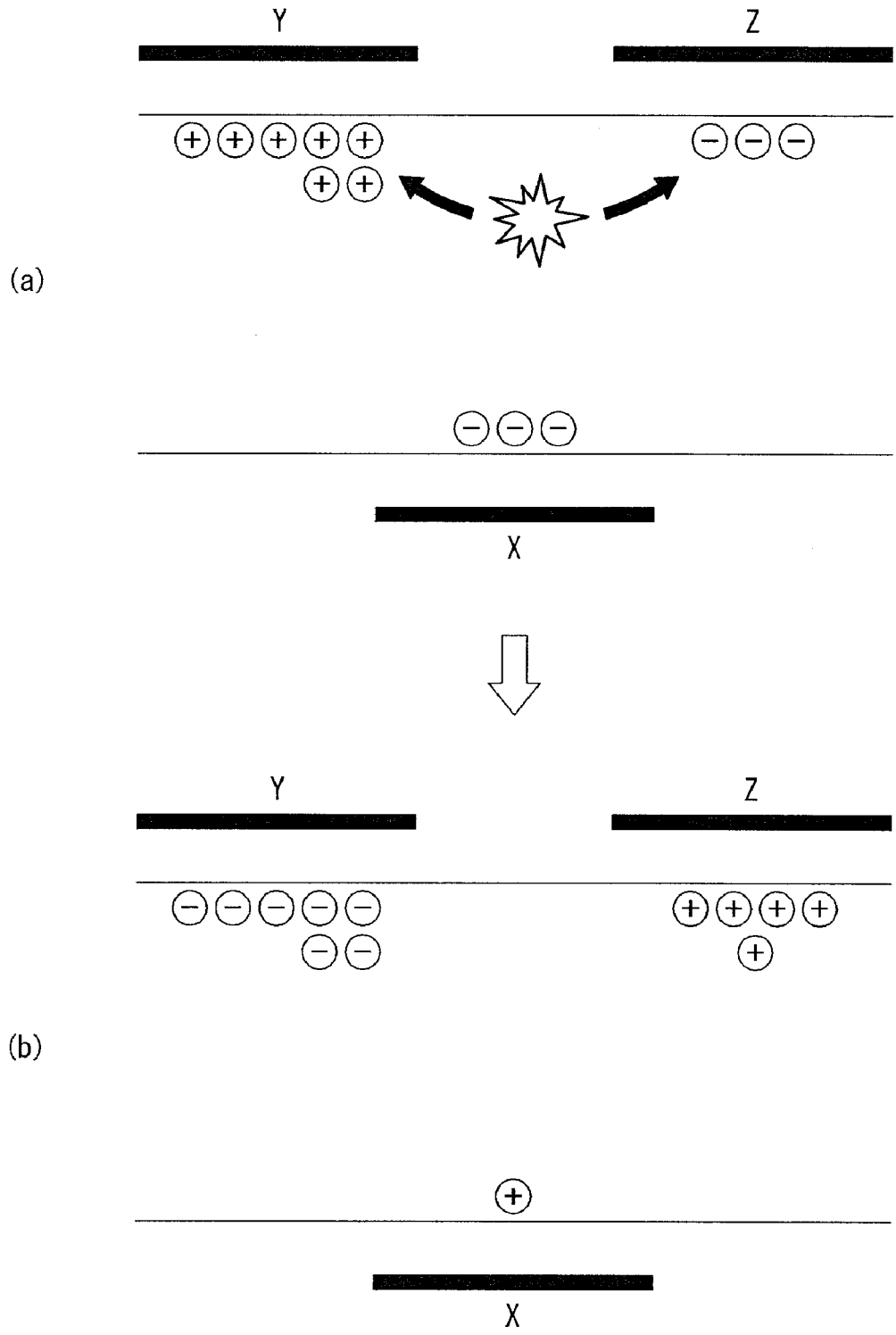

On the other hand, if the address electrode X is floated in the sustain period as shown in FIG. 5, the generation of the opposite discharge may be suppressed by drawing the sustain discharge generated between the scan electrode Y and the sustain electrode Z toward the scan electrode Y and the sustain electrode Z as shown in (a) of FIG. 8, and the sustain discharge may stably occur between the scan electrode Y and the sustain electrode Z.

After the generation of the sustain discharge, as shown in (b) of FIG. 8, negative charges may be accumulated on the scan electrode Y, and positive charges may be accumulated on the sustain electrode Z. Therefore, if the sustain voltage Vs is supplied to the sustain electrode Z and the ground level voltage GND is supplied to the scan electrode Y, the sustain discharge may again occur. In other words, the stable sustain discharge may occur.

A reason why the sustain signal supplied to the scan electrode and the sustain signal supplied to the sustain electrode overlap each other while floating the address electrode in the sustain period is described below.

Figure 9:
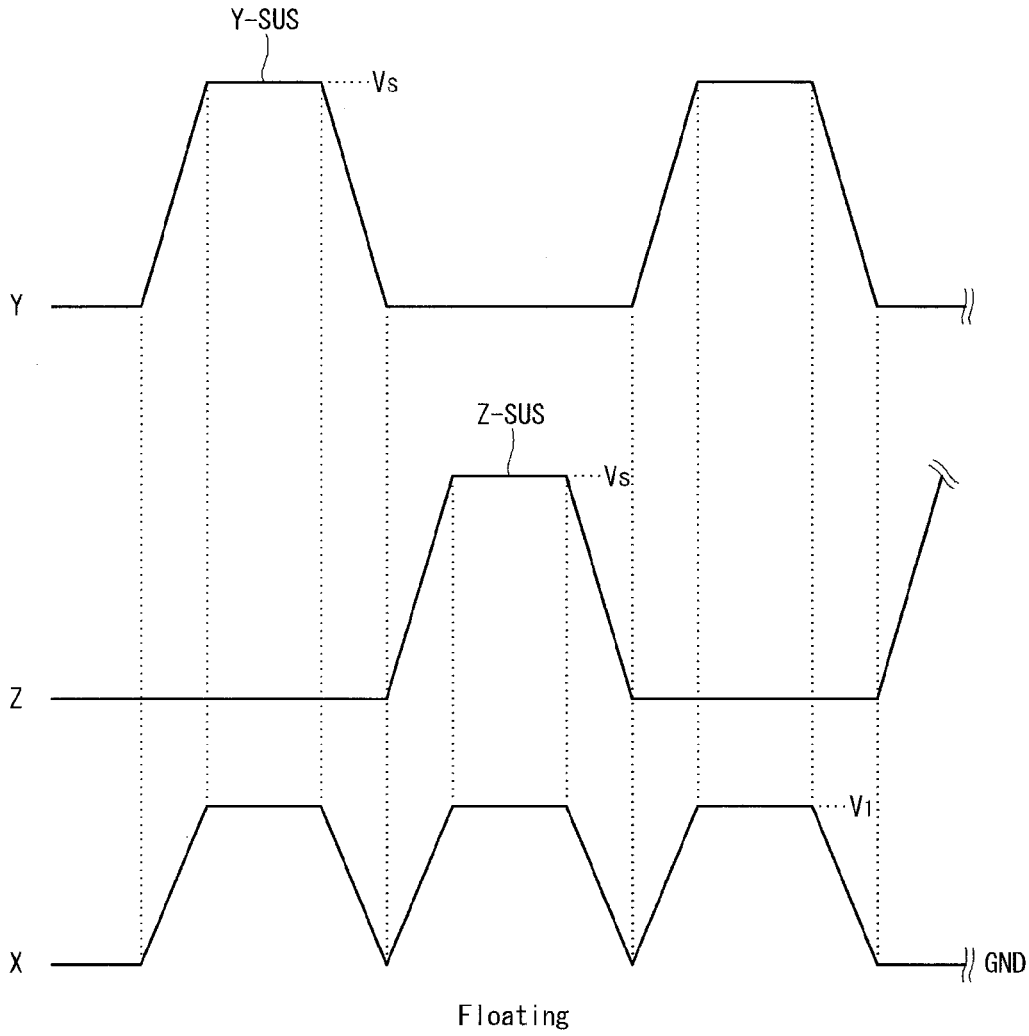

FIG. 9 illustrates that the sustain signal Y-SUS supplied to the scan electrode Y and the sustain signal Z-SUS supplied to the sustain electrode Z do not overlap each other while floating the address electrode in the sustain period.

In this case, when the voltage of the sustain signal supplied to the scan electrode or the sustain electrode rises, a voltage is induced to the floated address electrode. Therefore, the voltage of the address electrode may rise up to a first voltage V1. Further, when the voltage of the sustain signal supplied to the scan electrode or the sustain electrode falls, the voltage of the address electrode may fall.

Figure 10:
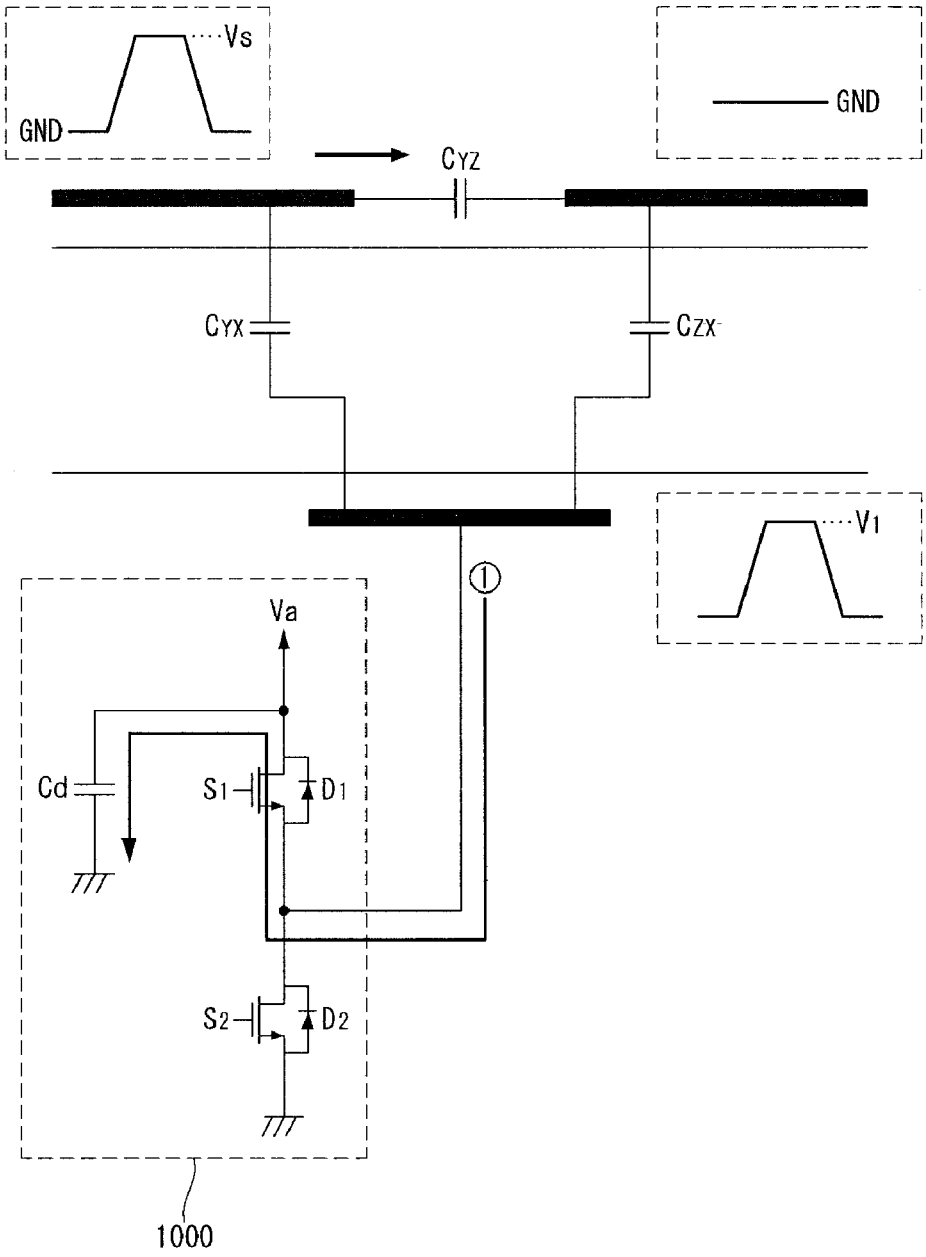

As shown in FIG. 10, the discharge cell may be defined by an equivalent circuit comprised of a first capacitor Cyz between the scan electrode Y and the sustain electrode Z, a second capacitor Cyx between the scan electrode Y and the address electrode X, and a third capacitor Czx between the sustain electrode Z and the address electrode X.

A data driver 1000 supplying the data signal to the address electrode X may include first and second switches S1 and S2 sequentially positioned between a data voltage source generating a data voltage Va and a ground and a data voltage capacitor Cd storing the data voltage Va. In the data driver 1000, the address electrode X may be connected between the first and second switches S1 and S2. The first switch S1 may include a first diode D1 as an inner diode, and the second switch S2 may include a second diode D2 as an inner diode. Each of the first and second switches S1 and S2 may be implemented as a data integrated circuit (IC).

The first and second switches S1 and S2 are turned off in a state where the address electrode X is floated.

When the address electrode X is floated and the voltage of the address electrode X rises up to the first voltage V1 in the sustain period as shown in FIG. 9, the voltage of the address electrode X may be stored in the data voltage capacitor Cd through the first diode D1 of the first switch S1 as shown in FIG. 10. Hence, the voltage stored in the data voltage capacitor Cd may excessively increase, and also a voltage of the data signal supplied to the address electrode X during the address period may excessively increase. As a result, the address discharge may unstably occur.

Figure 11:
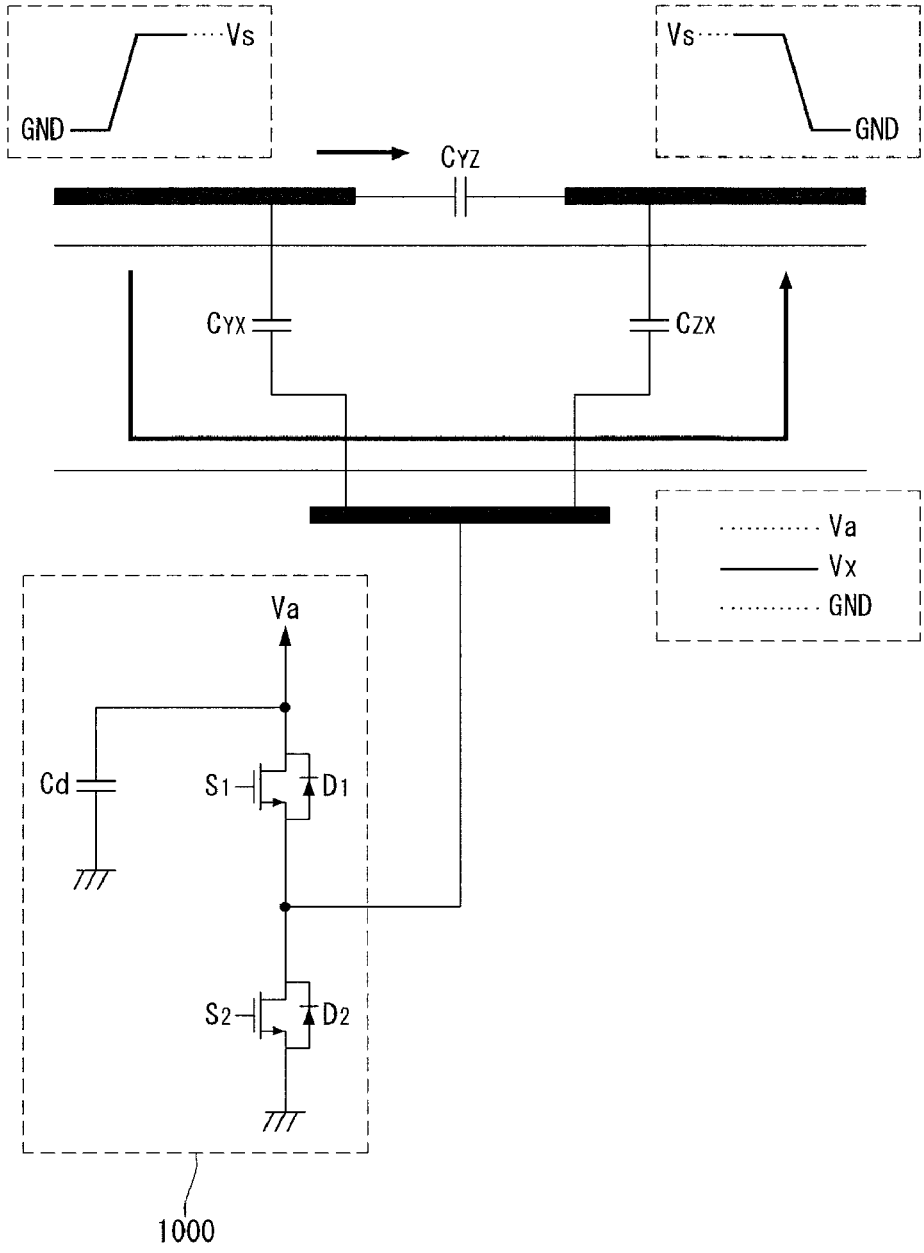

On the other hand, if the sustain signal supplied to the scan electrode and the sustain signal supplied to the sustain electrode overlap each other while floating the address electrode in the sustain period as shown in FIG. 5, the voltage of the sustain electrode may fall from the sustain voltage Vs to the ground level voltage GND while the voltage of the scan electrode rises from the ground level voltage GND to the sustain voltage Vs as shown in FIG. 11.

Accordingly, a voltage which is induced to the floated address electrode is substantially zero, and the voltage of the address electrode may be held at the voltage Vx even if the address electrode is floated and the sustain signal is supplied to the scan electrode or the sustain electrode. Hence, the voltage of the address electrode may not be stored in the data voltage capacitor Cd. As a result, the address discharge may be prevented from unstably occurring.

In other words, when the address electrode is floated in the sustain period, it is preferable that the sustain signal supplied to the scan electrode and the sustain signal supplied to the sustain electrode overlap each other so that the stable address discharge occurs by reducing a magnitude of the voltage stored in the data voltage capacitor Cd.

A relationship between the distance between the scan electrode and the sustain electrode and the driving efficiency and a relationship between the distance and a firing voltage are described below.

Figure 12:
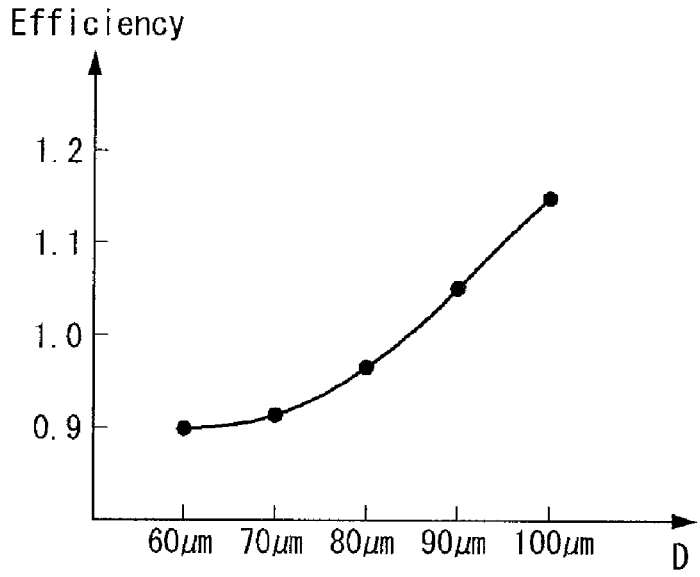
Figure 12:
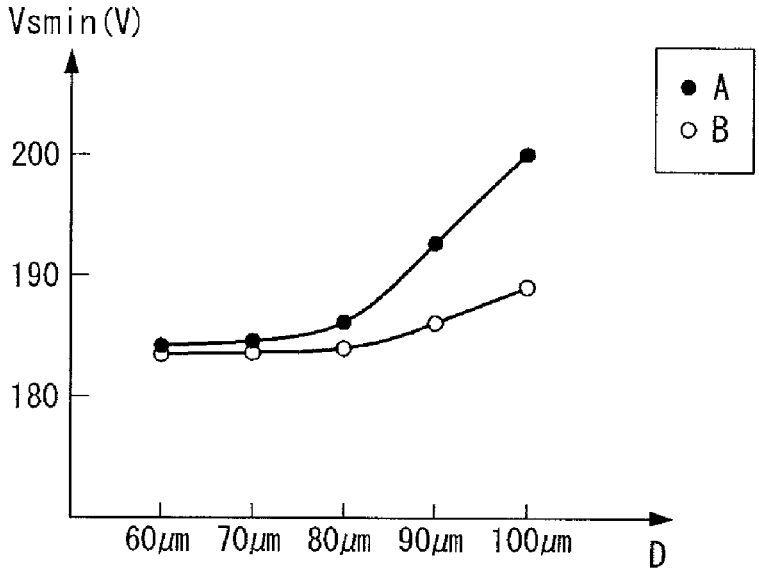

As shown in (a) of FIG. 12, as a distance D between the scan electrode and the sustain electrode increases, the driving efficiency may increase. Because it is possible to use a positive column in the sustain discharge due to the sufficiently long distance D between the scan electrode and the sustain electrode. Hence, a luminance may be improved.

As shown in (b) of FIG. 12, as the distance D between the scan electrode and the sustain electrode increases, a firing voltage Vsmin may increase. The firing voltage Vsmin is a voltage at a time when all the discharge cells of the plasma display panel are turned on in a full white image.

For example, as shown in (b) of FIG. 12, in a case "A" where the ground level voltage GND is supplied to the address electrode in the sustain period as shown in FIG. 6, the firing voltage Vsmin slightly rises when the distance D between the scan electrode and the sustain electrode is 60 μm to 80 μm. Further, when the distance D between the scan electrode and the sustain electrode is equal to or greater than 80 μm, the firing voltage Vsmin sharply rises because the generation of the opposite discharge sharply increases in the distance D equal to or greater than 80 μm.

On the other hand, in a case "B" where the address electrode is floated in the sustain period as shown in FIG. 5, the firing voltage Vsmin in the case "B" is less than the firing voltage Vsmin in the case "A" even if the distance D between the scan electrode and the sustain electrode increases.

Furthermore, when the distance D between the scan electrode and the sustain electrode is equal to or greater than 80 μm, the firing voltage Vsmin in the case "B" does not sharply rise and slightly rises. As a result, a difference between the firing voltage Vsmin in the case "B" and the firing voltage Vsmin in the case "A" increases in the distance D equal to or greater than 80 μm.

Figure 13:
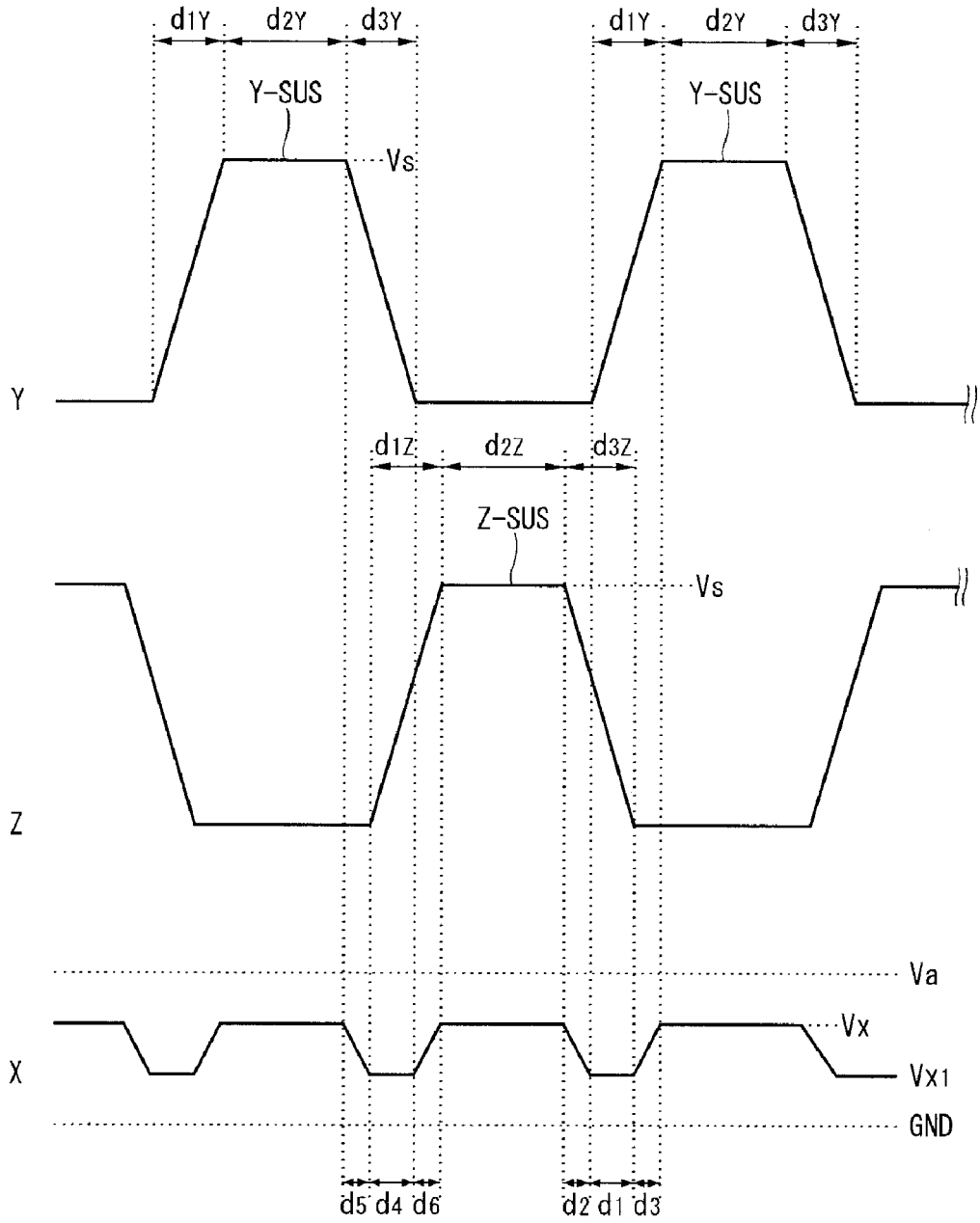
FIGS. 13 to 15 illustrate another exemplary driving method in a sustain period.
Figure 14:
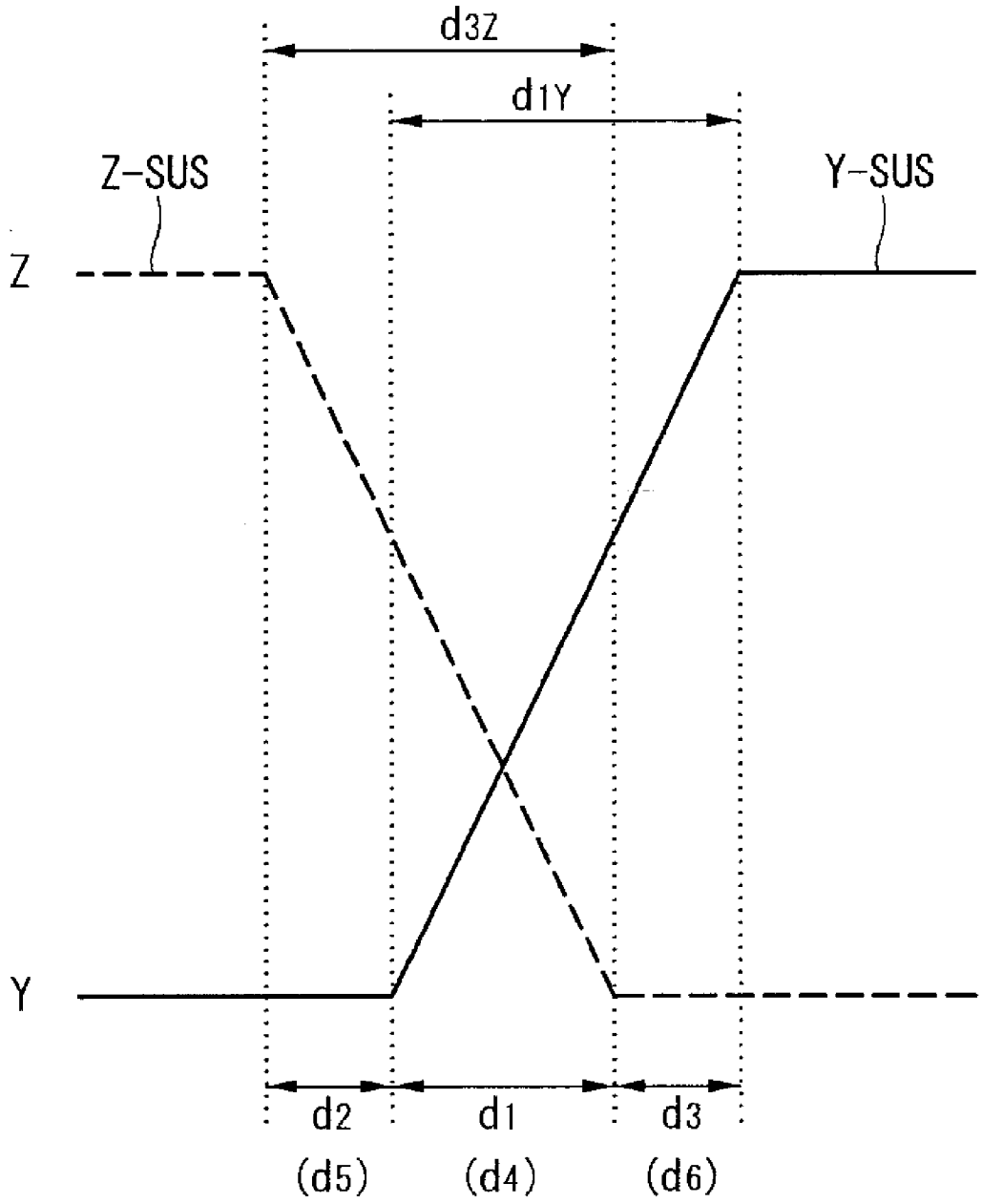
Figure 15:
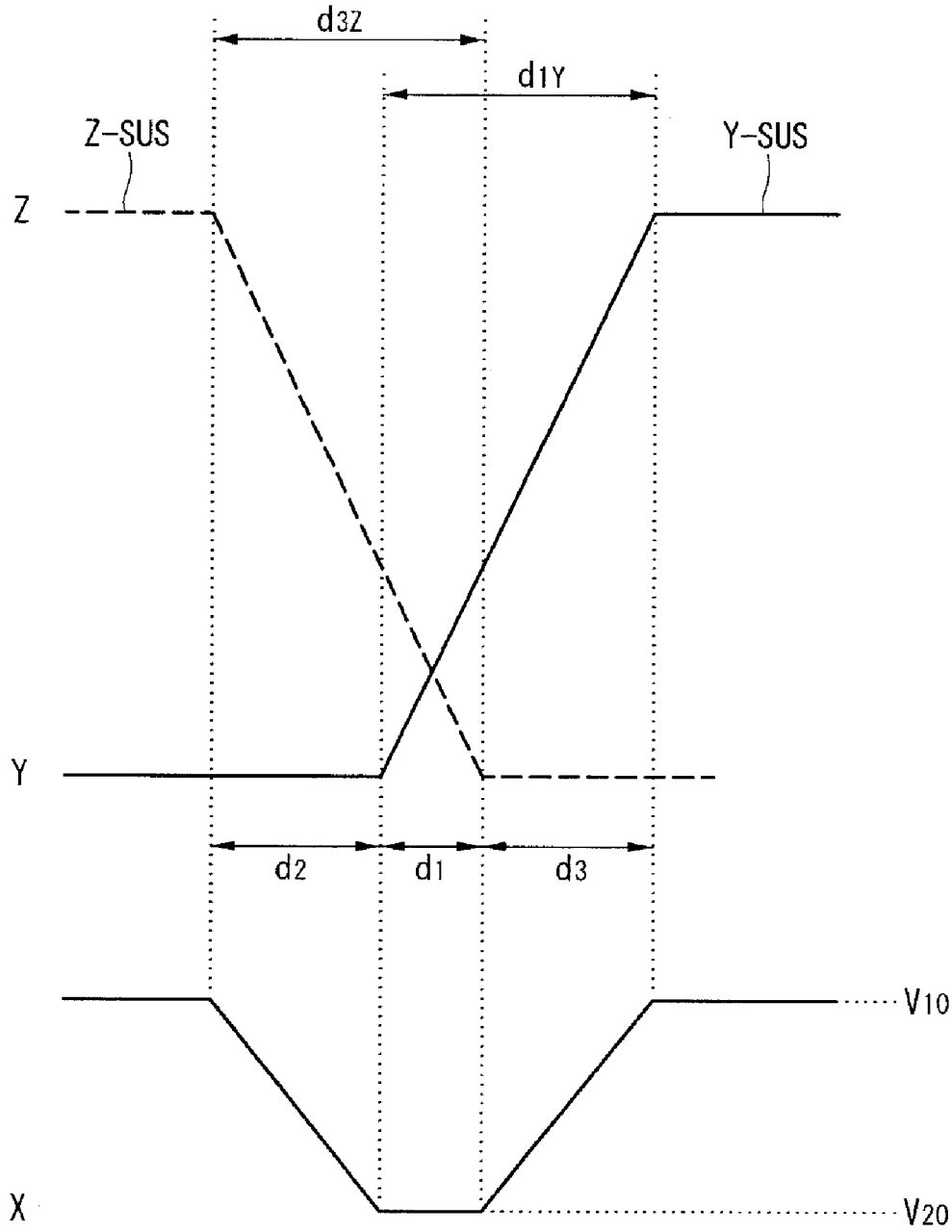

Considering the description of FIG. 12, when the distance between the scan electrode and the sustain electrode is equal to or greater than 80 μm, it mat be preferable that the sustain signal supplied to the scan electrode and the sustain signal supplied to the sustain electrode overlap each other while floating the address electrode in the sustain period FIGS. 13 to 15 illustrate another exemplary driving method in a sustain period.

As shown in FIG. 13, in a sustain period, a rising period d1*y* of a sustain signal Y-SUS supplied to the scan electrode Y may partially overlap a falling period d3*z* of a sustain signal Z-SUS supplied to the sustain electrode Z, and a falling period d3*y* of the sustain signal Y-SUS supplied to the scan electrode Y may partially overlap a rising period d1*z* of the sustain signal Z-SUS supplied to the sustain electrode Z.

A voltage of the address electrode X in an overlap period between the sustain signal Y-SUS and the sustain signal Z-SUS may be less than a voltage of the address electrode X in a non-overlap period between the sustain signal Y-SUS and the sustain signal Z-SUS.

In FIG. 13, a partial overlap period between the rising period d1*y* of the sustain signal Y-SUS supplied to the scan electrode Y and the falling period d3*z* of the sustain signal Z-SUS supplied to the sustain electrode Z is called a first period d1, a portion of the falling period d3*z* of the sustain signal Z-SUS not overlapping the rising period d1*y* of the sustain signal Y-SUS is called a second period d2, and a portion of the rising period d1*y* of the sustain signal Y-SUS not overlapping the falling period d3*z* of the sustain signal Z-SUS is called a third period d3. Further, a partial overlap period between the falling period d3*y* of the sustain signal Y-SUS and the rising period d1*z* of the sustain signal Z-SUS is called a fourth period d4, a portion of the falling period d3*y* of the sustain signal Y-SUS not overlapping the rising period d1*z* of the sustain signal Z-SUS is called a fifth period d5, and a portion of the rising period d1*z* of the sustain signal Z-SUS not overlapping the falling period d3*y* of the sustain signal Y-SUS is called a sixth period d6.

In this case, the voltage of the address electrode in the first period d1 may be less than the voltage of the address electrode in the second and third periods d2 and d3, and the voltage of the address electrode in the fourth period d4 may be less than the voltage of the address electrode in the fifth and sixth periods d5 and d6.

Because the sustain signal Y-SUS supplied to the scan electrode and the sustain signal Z-SUS supplied to the sustain electrode overlap each other in the first period d1 and the fourth period d4, the voltage of the address electrode may be uniformly held at a first address voltage Vx1 in the first and fourth periods d1 and d4. The voltage of the address electrode in the first period d1 may be substantially equal to the voltage of the address electrode in the fourth period d4 when a voltage change rate in the rising period d1*y* of the sustain signal Y-SUS is substantially equal to a voltage change rate in the rising period d1*z* of the sustain signal Z-SUS, and a voltage change rate in the falling period d3*y* of the sustain signal Y-SUS is substantially equal to a voltage change rate in the falling period d3*z* of the sustain signal Z-SUS.

It may be preferable that the voltage of the address electrode has a maximum voltage Vx in a hold period d2*y* of the sustain signal Y-SUS or a hold period d2*z* of the sustain signal Z-SUS.

The maximum voltage Vx of the address electrode and the first address voltage Vx1 in the sustain period is greater than the ground level voltage GND and is less than the voltage Va of the data signal.

Even if the rising period d1*y* and the falling period d3*y* of the sustain signal Y-SUS supplied to the scan electrode partially overlap the falling period d3*z* and the rising period d1*z* of the sustain signal Z-SUS supplied to the sustain electrode, respectively, the voltage induced to the data voltage capacitor may be sufficiently reduced because the voltage of the address electrode in the sustain period has a voltage greater than the ground level voltage GND and less than the voltage Va of the data signal Accordingly, the address discharge may stably occur.

The voltage of the address electrode may gradually fall from the maximum voltage Vx to the first address voltage Vx1 in the fifth period d5 and the second period d2. Further, the voltage of the address electrode may gradually rise from the first address voltage Vx1 to the maximum voltage Vx in the sixth period d6 and the third period d3.

When the rising period d1*y* and the falling period d3*y* of the sustain signal Y-SUS supplied to the scan electrode partially overlap the falling period d3*z* and the rising period d1*z* of the sustain signal Z-SUS supplied to the sustain electrode, respectively, it may be preferable that a length of the overlap period (i.e., the first and fourth periods d1 and d4) between the sustain signal Y-SUS and the sustain signal Z-SUS is sufficiently long as shown in FIG. 14.

Preferably, a length of the first period d1 may be longer than a length of at least one of the second period d2 and the third period d3, and a length of the fourth period d4 may be longer than a length of at least one of the fifth period d5 and the sixth period d6.

More preferably, the length of the first period d1 may be longer than a sum of a length of the second period d2 and a length of the third period d3, and the length of the fourth period d4 may be longer than a sum of a length of the fifth period d5 and a length of the sixth period d6.

As above, because the lengths of the overlap periods d1 and d4 between the sustain signal Y-SUS and the sustain signal Z-SUS are sufficiently long, the voltage induced to the data voltage capacitor may be further reduced even if the rising period d1*y* and the falling period d3*y* of the sustain signal Y-SUS partially overlap the falling period d3*z* and the rising period d1*z* of the sustain signal Z-SUS, respectively. Accordingly, the address discharge may stably occur.

If the lengths of the overlap periods d1 and d4 are excessively short (for example, if the length of the first period d1 is shorter than the length of the second period d2 and the length of the third period d3 and the length of the fourth period d4 is shorter than the length of the fifth period d5 and the length of the sixth period d6 as shown in FIG. 15), a voltage induced to the data voltage capacitor in the sustain period may increase because a difference between a maximum voltage V10 and a minimum voltage V20 of the address electrode X increases in the sustain period. Hence, the address discharge may unstably occur.

Accordingly, it may be preferable that the length of the first period d1 is longer than the length of at least one of the second period d2 and the third period d3, and the length of the fourth period d4 is longer than the length of at least one of the fifth period d5 and the sixth period d6.

Figure 16:
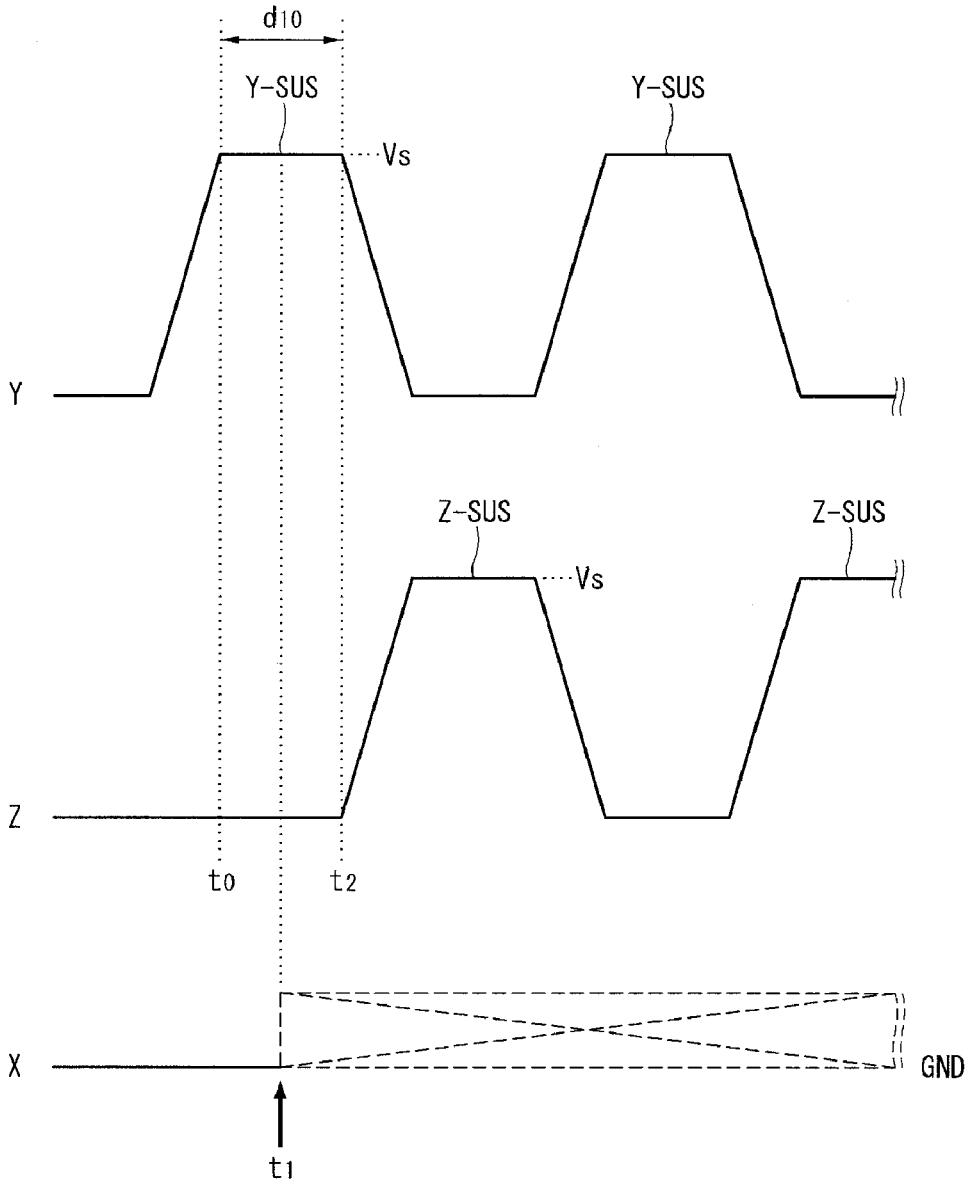
FIGS. 16 to 18 illustrate a floating time point of an address electrode.
Figure 17:
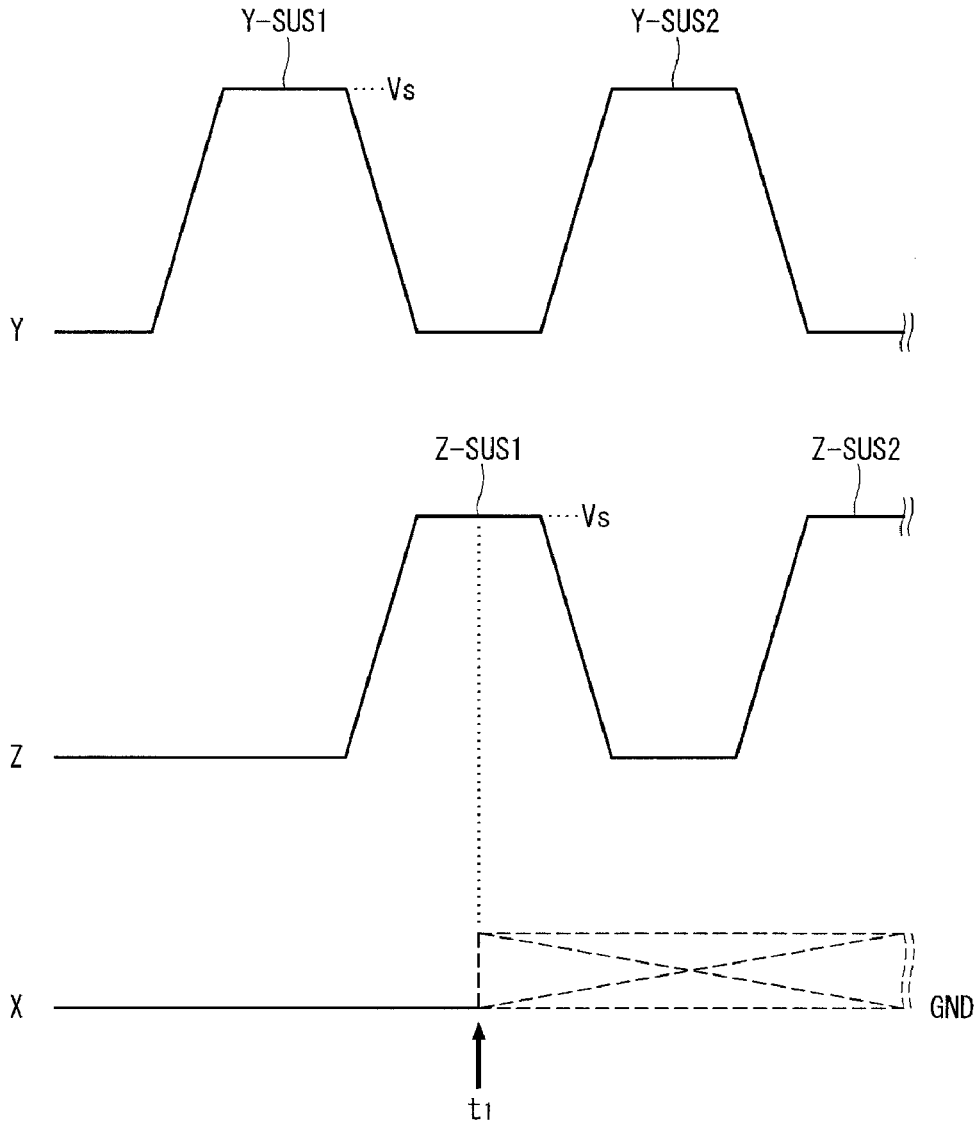
Figure 18:
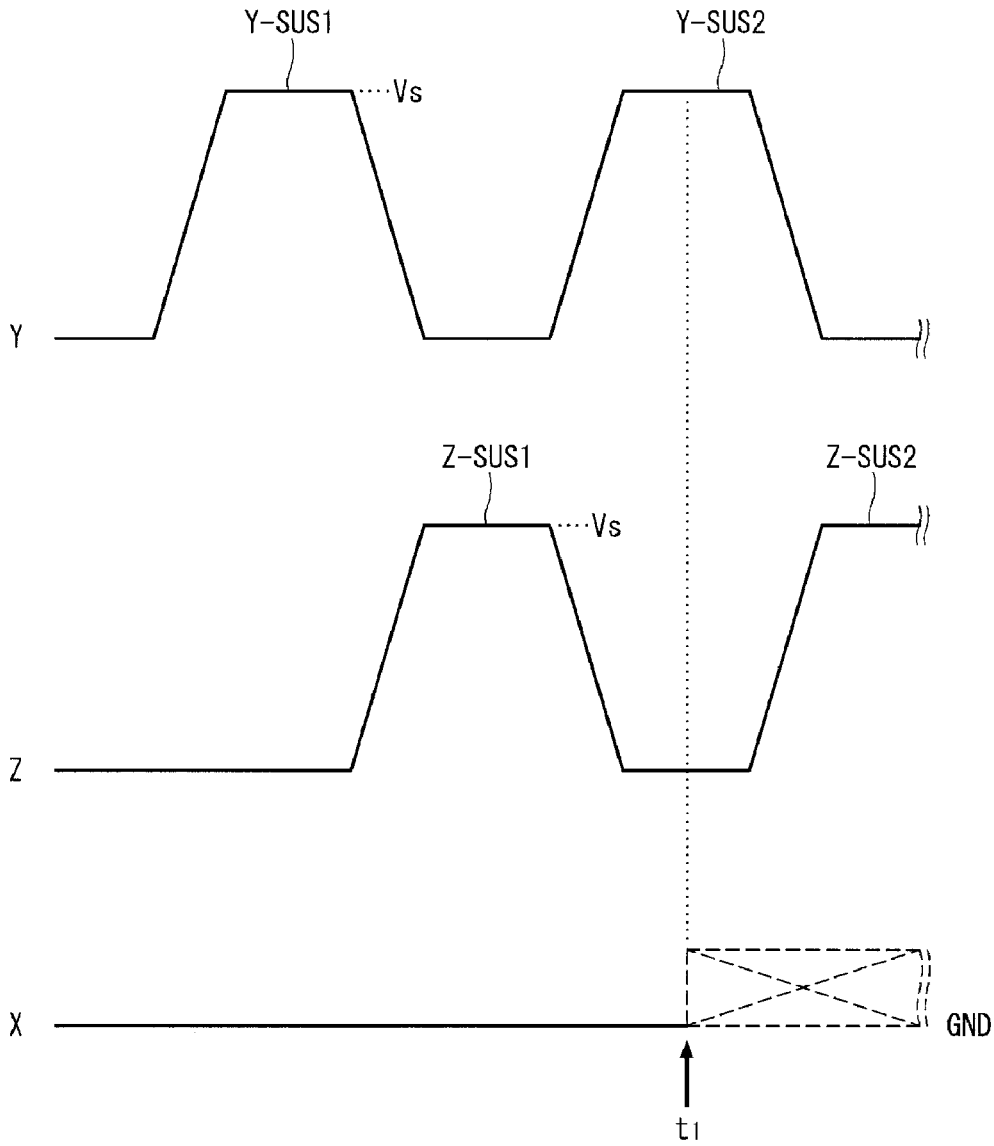

FIGS. 16 to 18 illustrate a floating time point of the address electrode.

As shown in FIG. 16, the floating of the address electrode X may start while the voltage of the scan electrode Y and the voltage of the sustain electrode Z are held substantially constant in the sustain period.

Preferably, the address electrode X may be floated during a hold period d10 of each of the scan electrode Y and the sustain electrode Z in the sustain period. More specifically, a floating time point t1 of the address electrode X may be positioned between a start time point t0 and an end time point t2 of the hold period d10 of the sustain signal Y-SUS supplied to the scan electrode Y or the sustain signal Z-SUS supplied to the sustain electrode Z.

Further, the address electrode X is not floated in a rising period and a falling period of the sustain period during which a voltage of the sustain signal Y-SUS or Z-SUS varies.

If the floating of the address electrode starts in the rising period and the falling period of the sustain period during which the voltage of the sustain signal Y-SUS or Z-SUS varies, the voltage of the address electrode may vary in an initial floating stage. Thus, an amount of voltage entering the data voltage capacitor may increase.

On the other hand, if the floating of the address electrode starts during the hold period d10 of the sustain signals Y-SUS and Z-SUS, changes in the voltage of the address electrode X in the initial floating stage may be prevented. Hence, the address discharge may occur more stably.

The ground level voltage GND may be supplied to the address electrode during a supply of a first sustain signal supplied to the scan electrode or the sustain electrode, and the floating of the address electrode may start during a hold period of a sustain signal subsequent to the first sustain signal, so that a floating timing margin of the address electrode is secured.

For example, as shown in FIG. 17, the address electrode X may not be floated while a first sustain signal Y-SUS1 is supplied to the scan electrode Y, and the floating of the address electrode may start during a hold period of a first sustain signal Z-SUS1 supplied to the sustain electrode Z subsequent to the first sustain signal Y-SUS1.

In addition, as shown in FIG. 18, the address electrode X may not be floated while a pair of first sustain signals Y-SUS1 and Z-SUS1 are respectively supplied to the scan electrode Y and the sustain electrode Z, and the floating of the address electrode may start during a hold period of a sustain signal Y-SUS2 supplied to the scan electrode subsequent to the pair of first sustain signals Y-SUS1 and Z-SUS1.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display apparatus comprising:

a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell; and a driver that supplies a sustain signal to the scan electrode and the sustain electrode in a sustain period of at least one of a plurality of subfields of a frame, wherein the sustain signal includes a rising period during which a voltage of the sustain signal rises, a hold period during which the voltage is held at a maximum voltage, and a falling period during which the voltage falls, wherein a rising period of a sustain signal supplied to the scan electrode overlaps a falling period of a sustain signal supplied to the sustain electrode in the sustain period, and a falling period of the sustain signal supplied to the scan electrode overlaps a rising period of the sustain signal supplied to the sustain electrode in the sustain period, wherein the address electrode is electrically floated in the sustain period, wherein the rising period of the sustain signal supplied to the scan electrode at least partially overlaps the falling period of the sustain signal supplied to the sustain electrode, and the falling period of the sustain signal supplied to the scan electrode at least partially overlaps the rising period of the sustain signal supplied to the sustain electrode, wherein a partial overlap period between the rising period of the sustain signal supplied to the scan electrode and the falling period of the sustain signal supplied to the sustain electrode is a first period, a portion of the falling period of the sustain signal supplied to the sustain electrode not overlapping the rising period of the sustain signal supplied to the scan electrode is a second period and a portion of the rising period of the sustain signal supplied to the scan electrode not overlapping the falling period of the sustain signal supplied to the sustain electrode is a third period, wherein a partial overlap period between the falling period of the sustain signal supplied to the scan electrode and the rising period of the sustain signal supplied to the sustain electrode is a fourth period, a portion of the falling period of the sustain signal supplied to the scan electrode not overlapping the rising period of the sustain signal supplied to the sustain electrode is a fifth period, and a portion of the rising period of the sustain signal supplied to the sustain electrode not overlapping the falling period of the sustain signal supplied to the scan electrode is a sixth period, and wherein a voltage of the address electrode in the first period is less than a voltage of the address electrode in the second and third periods, and a voltage of the address electrode in the fourth period is less than a voltage of the address electrode in the fifth and sixth periods.

2. The plasma display apparatus of claim 1, wherein a voltage of the address electrode in the first and fourth periods is held substantially constant.

3. The plasma display apparatus of claim 1, wherein a voltage of the address electrode in the first period is substantially equal to a voltage of the address electrode in the fourth period.

4. The plasma display apparatus of claim 1, wherein a voltage of the address electrode gradually rises or gradually falls in the second, third, fifth, and sixth periods.

5. The plasma display apparatus of claim 1, wherein a voltage of the address electrode has a maximum voltage in a hold period of the sustain signal supplied to the scan electrode or a hold period of the sustain signal supplied to the sustain electrode.

6. The plasma display apparatus of claim 1, wherein a length of the first period is equal to or longer than a length of at least one of the second period and the third period, and a length of the fourth period is equal to or longer than a length of at least one of the fifth period and the sixth period.

7. The plasma display apparatus of claim 6, wherein the length of the first period is longer than a sum of a length of the second period and a length of the third period, and the length of the fourth period is longer than a sum of a length of the fifth period and a length of the sixth period.

8. A plasma display apparatus comprising:

a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell; and a driver that supplies a sustain signal to the scan electrode and the sustain electrode in a sustain period of at least one of a plurality of subfields of a frame, wherein the sustain signal includes a rising period during which a voltage of the sustain signal rises, a hold period during which the voltage is held at a maximum voltage, and a falling period during which the voltage falls, wherein a rising period of a sustain signal supplied to the scan electrode overlaps a falling period of a sustain signal supplied to the sustain electrode in the sustain period, and a falling period of the sustain signal supplied to the scan electrode overlaps a rising period of the sustain signal supplied to the sustain electrode in the sustain period, wherein the address electrode is electrically floated in a period during which a voltage of the scan electrode and a voltage of the sustain electrode are held substantially constant in the sustain period, wherein a floating time point of the address electrode is positioned between a start time point and an end time point of a hold period of the sustain signal applied to the scan electrode or the sustain electrode.

9. A plasma display apparatus comprising:

a plasma display panel including a front substrate on which a scan electrode and a sustain electrode are positioned parallel to each other, a rear substrate on which an address electrode is positioned to cross the scan electrode and the sustain electrode, and a barrier rib that is positioned between the front substrate and the rear substrate to partition a discharge cell; and a driver that supplies a sustain signal to the scan electrode and the sustain electrode in a sustain period of at least one of a plurality of subfields of a frame, wherein the sustain signal includes a rising period during which a voltage of the sustain signal rises, a hold period during which the voltage is held at a maximum voltage, and a falling period during which the voltage falls, wherein a rising period of a sustain signal supplied to the scan electrode overlaps a falling period of a sustain signal supplied to the sustain electrode in the sustain period, and a falling period of the sustain signal supplied to the scan electrode overlaps a rising period of the sustain signal supplied to the sustain electrode in the sustain period, wherein the address electrode is electrically floated in a period during which a voltage of the scan electrode and a voltage of the sustain electrode are held substantially constant in the sustain period, wherein a ground level voltage is supplied to the address electrode while a first sustain signal is supplied to one of the scan electrode and the sustain electrode or a pair of first sustain signals are supplied to the scan electrode and the sustain electrode, and floating of the address electrode starts in a hold period of a sustain signal subsequent to the first sustain signal or the pair of first sustain signals.

* * * * *